US005301429A

United States Patent [19]

Bundy

[11] Patent Number: 5,301,429

[45] Date of Patent: Apr. 12, 1994

[54] TOOL FOR REMOVING MOLDINGS AND THE LIKE

[76] Inventor: Douglas M. Bundy, P.O. Box 56, Naubinway, Mich. 49762

[21] Appl. No.: 18,010

[22] Filed: Feb. 16, 1993

[51] Int. Cl.[5] ..... B26B 3/00

[52] U.S. Cl. ..... 30/169; 15/236.01; 30/277

[58] Field of Search ..... 30/168, 169, 171, 277; 15/236.01, 236.02; 81/45; 294/54.5, 49, 57

[56] References Cited

U.S. PATENT DOCUMENTS

| | | | |
|---|---|---|---|
| 3,092,411 | 6/1963 | Hardy | 30/169 X |
| 3,987,827 | 10/1976 | Mills | 81/45 |
| 4,381,604 | 5/1983 | Horst | 30/169 |
| 5,219,378 | 6/1993 | Arnold | 30/169 |

*Primary Examiner*—Douglas D. Watts
*Attorney, Agent, or Firm*—Weintraub, DuRoss & Brady

[57] ABSTRACT

A powered tool removes moldings or other mounted item without imparting damage to the surface being worked upon. The tool has a blade affixed to a handle. The handle and blade are interdigitated so as to form a flat surface along the bottom of the tool. This smooth, flat surface allows the tool to be deployed upon the surface and the blade then slid underneath the molding, such that, by a pneumatic force or other power supplied thereto, the tool easily lifts the molding away from the surface. The handle of the tool has a gripping portion and blade-engaging portion, such that the tool can be comfortably gripped to effect the removal of the molding. The damage to the surface is eliminated when using the present tool, in part, by the formation of the blade of plastic.

5 Claims, 1 Drawing Sheet

TOOL FOR REMOVING MOLDINGS AND THE LIKE

BACKGROUND OF THE INVENTION

1. Field of the Invention

The present invention concerns a tool for removing moldings and the like from surfaces. More particularly, the present invention concerns a tool for removing moldings from vehicles by pulsatingly traversing the surface thereof.

2. Description of the Related Art

Tools for removing or scraping objects off surfaces have been known in the art. Such a device is typified by and taught in U.S. Pat. No. 4,466,851 which issued Aug. 21, 1984 to Hoffman and is entitled "METHOD AND APPARATUS FOR SCRAPING ADHERENT MATERIAL FROM A SMOOTH WORK SURFACE." Hoffman teaches a cylindrical member having a hose connected to a pneumatic power supply or air hammer at one end thereof. At the opposite end of the cylindrical member there is mounted a blade having an angled edge at the forward end thereof. In operation, the device of Hoffman is driven by the pneumatic power across the surface with the blade being driven underneath the object to be removed.

However, this type of device has drawbacks. Particularly, the device tends to gouge or scratch the surface being worked upon. This is due to the lack of proximity of the tool to the surface. In order to grip the tool, the tool must be held at an angle. This impedes the ability of the tool to smoothly traverse the body surface and therefore impairs easy removal of the molding. Further, the tool creates the potential for damage to the surface, as the force is not fully applied to the molding, but to the surface being worked upon. In this way, the surface is damaged.

It is to be, thusly, appreciated that what is needed is a tool that offers suitable gripping for the user while providing closer proximity with the surface being worked upon. Further, the tool should be made of a material that lessens the effects upon the surface being worked upon. It is to these needs that the present invention is directed.

SUMMARY OF THE INVENTION

The present invention provides a tool for removing moldings or similar attachments from a surface and, in particular, an automobile body surface, without damaging the coating of the surface or the surface, per se. The present invention is a tool which is connectable to a power source comprising:

(a) a integrally formed handle having:
  (1) a gripping portion, the gripping portion comprising:
    (i) a first leg having a longitudinal axis therethrough, and
    (ii) a second leg, the second leg being integral with the first leg and angularly inclined with respect thereto at an angle greater than zero degrees and less than 180 degrees; and
  (2) a blade-engaging portion, the blade-engaging portion having a forward portion and a rearward portion, the blade-engaging portion further having a longitudinal axis that is vertically displaced from the longitudinal axis of the first leg of the gripping portion, the blade-engaging portion having a flat bottom surface and a flat upper surface, the upper surface having a beveled shoulder formed therein, the shoulder defining the forward portion and having a reduced thickness relative to the rearward portion;

(b) a blade having a forward portion, a medial portion and a rearward portion, the blade further having a planar upper surface and a lower surface, the forward portion having a beveled forward edge and a first thickness, the medial portion having an increased thickness relative to the first thickness, a shoulder provided on the lower surface separating the medial portion and the rearward portion, the rearward portion having a beveled rearward edge and a thickness less than the increased thickness of the medial portion, the rearward portion of the blade being interdigitally deployed within the blade-engaging portion of the handle; and (c) means for releasably connecting the blade to the handle.

The present invention may be pneumatically, hydraulically or otherwise fluid operated, with the preferred mode being suitable attachment to an air hammer. The present tool is particularly efficacious for removing body moldings from automotive body panels. The present invention will be more clearly understood with reference to the accompanying drawings. Throughout the various figures, like reference numerals refer to like parts, in which:

DETAILED DESCRIPTION OF THE DRAWING

Figure 1:
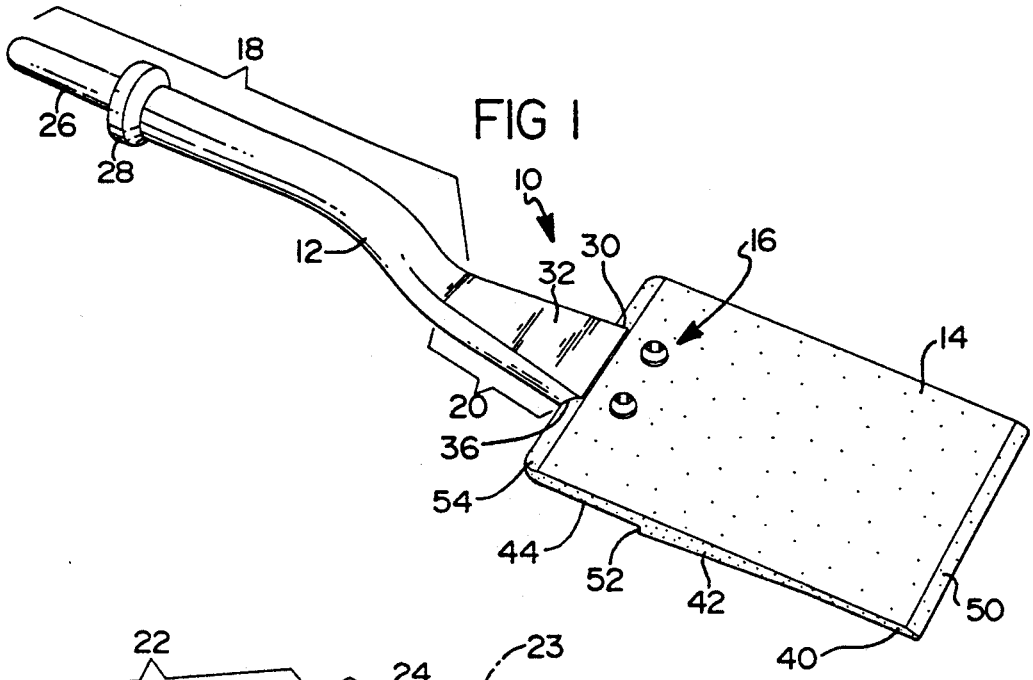
FIG. 1 is a perspective view of the tool of the present invention.
Figure 2:
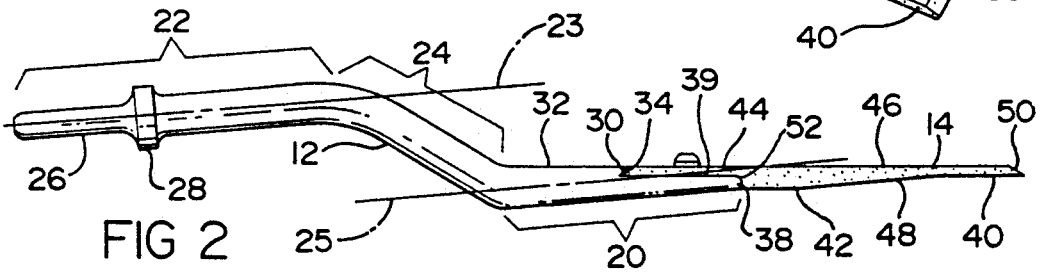
FIG. 2 is a side view of the tool of the present invention.
Figure 3:
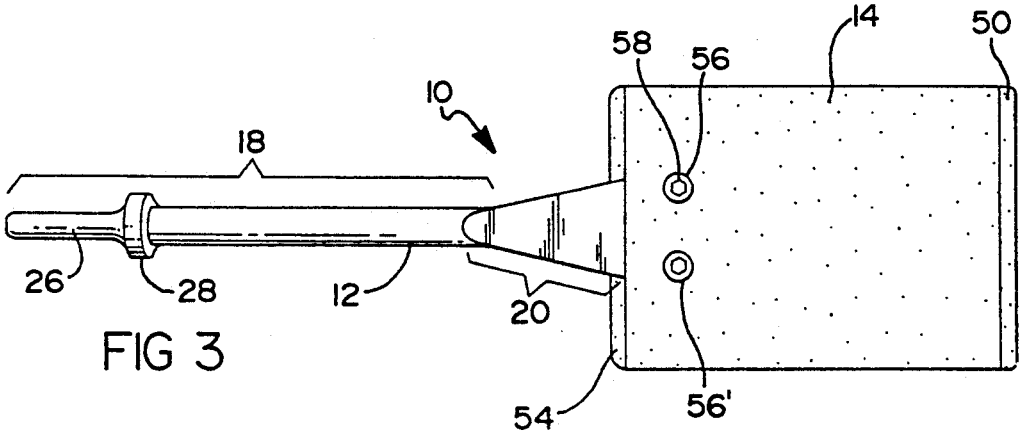
FIG. 3 is a top view of the tool of the present invention.

Referring now to FIGS. 1-3, there is shown therein the present invention, to wit, a tool 10 for removing moldings or other attachments from surfaces by pulsatingly traversing the surface, such as a vehicular body panel (not shown). The tool 10 comprises a handle 12, a blade 14 and means 16 for releasably connecting the blade 14 to the handle 12.

The handle 12 is a unitary member comprising a gripping portion 18 and a blade-engaging portion 20. The handle 12 is formed of steel or other suitably durable material to transmit a pressure of force to the blade 14, as will be described further herein below.

The gripping portion 18 comprises a first leg 22 and a second leg 24. The first leg 22 is, in the preferred embodiment, a substantially solid cylindrical member having a first longitudinal axis 23. Although not shown, the first leg 22 can, in alternate embodiments, be other than cylindrical in shape, such as cubic or the like. The first leg 22 has a rearward portion 26 onto which a tube (not shown) or other connection to preferably an air hammer or alternately another fluid power source (not shown) is affixed. A ring or flange 28 is formed on the first leg 22, the ring 28 acts as a stop or abutment to prevent the tube or other attachment from riding too far up on the handle 12.

The second leg 24 of the handle 12 is formed to a substantially similar in shape and circumference as the first leg 22 and is integral therewith. The second leg is angled relative to the first leg 22. Thus, by this structure the handle 12 takes a curvilinear structure to itself and provides a space between the plane of the blade and the plane of the first leg 22. As described below, this structure allows ease of gripping by the user while allowing the tool 10 to be deployed in close proximity to the surface being worked upon. The angulation of the second leg 24 is greater than zero degrees and less than 180 degrees, as shown. Optimally, the angle is between 30 and 60 degrees, with 35 degrees being a preferred angulation.

The blade-engaging portion 20 of the handle 12 is a, generally, flat member, having a thickness that reduces or tapers forwardly. The flat bottom of the blade-engaging portion 20 allows a flush contact with the surface being affected by the blade 14. This allows the blade 14 to be inserted underneath the molding to be removed and effects this efficiently, as will be discussed herein below in greater detail. The blade-engaging portion 20 has a longitudinal axis 25 that is parallel, but vertically displaced, from the longitudinal axis 23 of the first leg 22.

As can best be seen in FIG. 2, the blade-engaging portion 20 has a shoulder 30 formed along the upper surface 32 thereof. The shoulder 30 extends forwardly such that a nook or ledge 34 is defined therein. The shoulder 30 has a beveled edge 36. A planar portion 39 is defined between the beveled edge 36 and a forward edge 38 along the upper surface 32 thereof. The blade 14 is positioned for connection to the handle 12 by being seated on the ledge 34 and abutted against the shoulder 30, as described herein below.

The blade 14 is an integrally formed member having a forward portion 40, a medial portion 42 and a rearward portion 44. The blade 14 further comprises a planar upper surface 46 and a lower surface 48 which continues or extends through each of the various portions 40, 42, 44. The forward portion 40 has a beveled forward edge 50 and a first thickness. The medial portion 42 has an increased thickness relative to the first thickness of the forward portion 40. Thus, the blade 14 increases in thickness from the forward portion 40 to the medial portion 42.

A shoulder 52 is formed on the lower surface 48. The shoulder 52 separates the medial portion 42 from the rearward portion 44. The rearward portion 44 has a thickness less than the increased thickness of the medial portion 42. Thus, the rearward portion is formed to compatibly interdigitate with the handle 12. The rearward portion 44 of the blade 14 has a beveled rearward edge 54 which facilitates the interdigitation.

The blade 14 is formed of plastic preferably. The blade 14 is so formed because plastic offers a material durable enough to impart the force necessary to remove the moldings or other features, while allowing a material that will not scratch or gouge the surface being worked upon. When the surface is painted or otherwise in a finished condition, as with a car door for example, such a quality allows for the elimination of extra steps for refinishing a door or eliminating the permanent marring of the surface. This is an improvement over such tools known in the art.

As can be seen in the Figures, the blade 14 has an upwardly beveled rearward edge 54 that is disposed proximate the upper surface of the blade 14. The blade-engaging portion 20 of the handle 12 has a forward edge 39 that flushly contact the shoulder 52 of the blade 14, so that the force supplied by the power source is evenly transferred to the blade 14 from the handle 12. The blade-engaging portion 20 has its shoulder 30 recede, such that the shoulder 30 opens downwardly. The shoulder 30 and rearward edge 54 interface, such that the connection or interdigitation of the handle 12 and the blade 14 is complete.

To maintain the interdigitation, the tool 10 further comprises means 16 for releasably connecting the blade 14 to the handle 12. As shown in the Figures, the preferred means 16 for releasably connecting comprises at least one fastener, such as a screw 56, extending through the blade 14 and seating in the handle 12. The screw 56 has an Allen head 58 as shown, though other screw heads could be used. The blade 14 and the handle 12 have aligned apertures formed therein to receive therethrough the screws 56. The apertures of the handle 12 are further threaded correspondingly to the screws 56, 56' to effect a tight connection. Multiple screws and apertures can be utilized, as the two screws 56, 56' in the figures show. Alternately, other means 16 for connecting, such as glue, bolts, rivets or welds can be utilized to connect the members 12, 14.

Preferably, an air hammer is used to supply to power to drive the tool 10 pulsatingly across the surface being worked upon. A pneumatic source of power can also be used, as well as a hydraulic source. Although less preferred, the device could be operatively connected to an electrical power source.

In operation, the tool of the present invention is pulsatingly driven by an air hammer. The handle 12 transmits the force imparted thereto to the blade 14. The blade 14 is moving essentially flush with the surface being worked upon. In particularly, when the tool 10 is used to remove moldings from car body panels, which is the preferred environment of operation, the tool 10 can be deployed so that it is underneath the molding to be removed. The proximity to the surface is achieved by the structure of the handle 12, which allows ease of gripping without inclination of the blade 14. Further, the formation of the blade 14 from plastic avoids damages which may otherwise occur. Thus, damage to the surface is obviated and an effective molding removal tool 10 is the result.

Having, thus, described the invention, what is claimed is:

1. A tool connectable to a power source for removing moldings from a surface mounted thereupon, the tool comprising:

(a) a integrally formed handle having:

(1) a gripping portion comprising:

(i) a first leg, the first leg having a longitudinal axis, and (ii) a second leg, the second leg being integral with the first leg and angularly inclined with respect thereto angle greater than zero degrees and less than 180 degrees;

(2) a blade-engaging portion, the blade-engaging portion having a forward portion and a rearward portion, the blade-engaging portion further having a longitudinal axis that is vertically displaced from the longitudinal axis of the first leg of the gripping portion, the blade-engaging portion having a flat bottom surface and a flat upper surface, the upper surface having a beveled shoulder formed therein, the shoulder defining the forward portion and having a reduced thickness relative to the rearward portion;

(b) a integral blade having a forward portion, a medial portion and a rearward portion, the blade further having a planar upper surface and a lower surface, the forward portion having a beveled forward edge and a first thickness, the medial portion having an increased thickness relative to the first thickness, a shoulder being formed on the lower surface separating the medial portion and the rearward portion, the rearward portion having a beveled rearward edge and a thickness less than the increased thickness of the medial portion, the rearward portion of the blade being interdigitally deployed with the blade-engaging portion of the handle; and (c) means for releasably connecting the blade to the handle.

2. The tool of claim 1 wherein the blade has at least one aperture formed therein and the blade-engaging portion has at least one aperture formed therein, the means for releasably connecting being deployed therethrough the apertures.

3. The tool of claim 1 wherein the blade is formed of plastic.

4. The tool of claim 1 wherein the handle has a ring formed thereon.

5. The tool of claim 1 further comprising a fluid power source having means for connecting to the tool.

* * * * *